US010963000B2

(12) United States Patent
Zou et al.

(10) Patent No.: US 10,963,000 B2
(45) Date of Patent: Mar. 30, 2021

(54) LOW NOISE BANDGAP REFERENCE CIRCUIT AND METHOD FOR PROVIDING A LOW NOISE REFERENCE VOLTAGE

(71) Applicant: TDK Corporation, Tokyo (JP)

(72) Inventors: Lei Zou, Copenhagen (DK); Gino Rocca, Copenhagen (DK)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/475,061

(22) PCT Filed: Nov. 17, 2017

(86) PCT No.: PCT/EP2017/079661
§ 371 (c)(1),
(2) Date: Jun. 28, 2019

(87) PCT Pub. No.: WO2018/121917
PCT Pub. Date: Jul. 5, 2018

(65) Prior Publication Data

US 2019/0324491 A1 Oct. 24, 2019

(30) Foreign Application Priority Data

Dec. 28, 2016 (DE) ..... 102016125775.3

(51) Int. Cl.
*G05F 3/30* (2006.01)
*H04R 1/04* (2006.01)

(52) U.S. Cl.
CPC ..... *G05F 3/30* (2013.01); *H04R 1/04* (2013.01); *H04R 2410/00* (2013.01)

(58) Field of Classification Search
CPC .. G05F 3/30; G05F 3/267; H04R 1/04; H04R 2410/00
See application file for complete search history.

(56) References Cited

U.S. PATENT DOCUMENTS 6,930,537 B1 8/2005 Ceekala et al.
8,742,746 B1 6/2014 Abernethy
(Continued)

OTHER PUBLICATIONS

Gupta, V. et al., "Inside the Belly of the Beast: A Map for the Wary Bandgap Reference Designer when Confronting Process Variations," EE Times, Designlines, Power Management Designline, XP002777845, downloaded from https://www.eetimes.com/document.asp?doc_id=1273001 on Jun. 27, 2019, Feb. 18, 2005, 3 pages.
(Continued)

*Primary Examiner* — Kyle J Moody
*Assistant Examiner* — Lakaisha Jackson
(74) *Attorney, Agent, or Firm* — Slater Matsil, LLP

(57) ABSTRACT

A bandgap reference circuit and a method for providing a reference voltage are disclosed. In an embodiment a bandgap reference circuit includes a voltage generator including a first branch and a second branch and being configured to produce a reference voltage with a temperature coefficient lower than a given threshold, a supply circuit configured to provide a first current to the first branch and a second current to the second branch, and a control loop including a transconductance amplifier configured to provide an output signal representative of a difference between a first voltage of the first branch and a second voltage of the second branch and a filter coupled to an output of the transconductance amplifier, the filter configured to provide an output signal for controlling the first current and second current of the supply circuit.

16 Claims, 4 Drawing Sheets

(56) References Cited

U.S. PATENT DOCUMENTS

Figure 1:
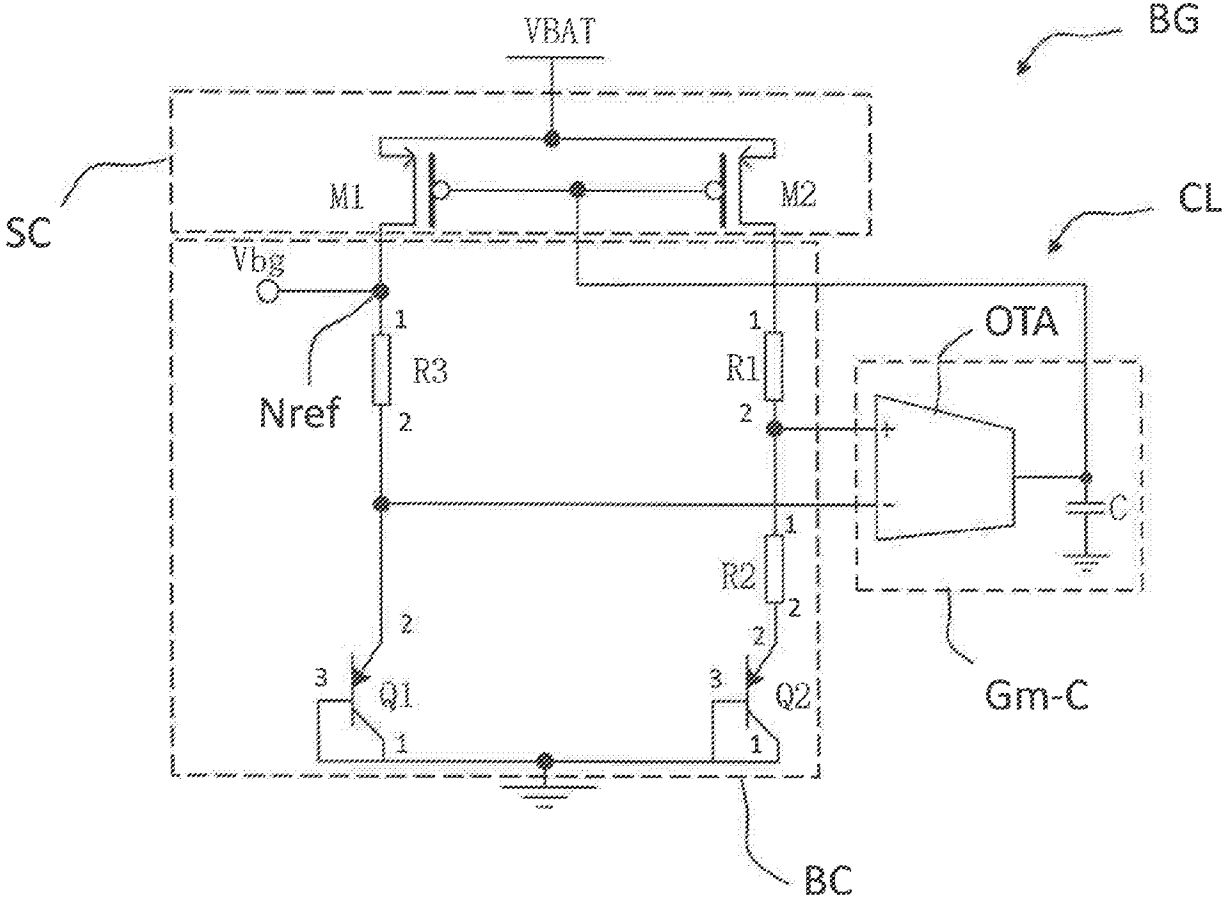

| | | | | |
|---|---|---|---|---|
| 9,519,304 | B1 | 12/2016 | Far | |
| 9,727,074 | B1 * | 8/2017 | Terryn | G05F 3/30 |
| 2006/0185429 | A1 | 8/2006 | Liu et al. | |
| 2008/0224761 | A1 | 9/2008 | Deng et al. | |
| 2009/0284242 | A1 * | 11/2009 | Motz | H03F 3/393 323/313 |
| 2009/0284304 | A1 | 11/2009 | Conte et al. | |
| 2010/0073070 | A1 * | 3/2010 | Ng | G05F 3/30 327/513 |
| 2013/0200878 | A1 | 8/2013 | Kalb et al. | |
| 2015/0181352 | A1 | 6/2015 | Astgimath et al. | |
| 2017/0269627 | A1 * | 9/2017 | Cook | G05F 3/267 |

OTHER PUBLICATIONS

Pathrose, J. et al., "Temperature Sensor Front End in SOI CMOS Operating up to 250° C.," IEEE Transactions on Circuits and Systems—II: Express Briefs, vol. 61, No. 7, Jul. 2014, 5 pages.

Stegall, W., "Floating Source-Follower Regulator," downloaded from http://waynestegall.com/audio/regfltsrcflwr.htm on Jun. 27, 2019, Copyright: 2012, 6 pages.

* cited by examiner

LOW NOISE BANDGAP REFERENCE CIRCUIT AND METHOD FOR PROVIDING A LOW NOISE REFERENCE VOLTAGE

The invention relates to a bandgap reference circuit and a method for providing a reference voltage. Furthermore the invention relates to a readout circuit comprising the bandgap reference circuit.

A bandgap reference, in particular a temperature compensated bandgap reference, is used to generate a temperature independent reference voltage or current. It is widely used in analog, digital, mixed-signal and RF-circuits. A bandgap reference with a sub-1 μA operating current is highly desired for ultra-low power design. However, a bandgap reference with such a low operation current normally has very large noise.

The object of the invention is to provide a bandgap reference circuit and a method for providing a reference voltage allowing for providing the reference voltage with low noise and low operation current.

This object is achieved by the features of the independent claims. Advantageous embodiments of the invention are given in the sub-claims.

The invention is distinguished according to a first aspect by a bandgap reference circuit comprising a voltage generator, a supply circuit and a control loop. The voltage generator comprises a first and a second branch and is configured to produce a reference voltage with a temperature coefficient lower than a given threshold. The supply circuit is configured to provide a first current to the first branch and a second current to the second branch of the voltage generator. The control loop comprises a transconductance amplifier configured and arranged to provide an output signal representative of a difference between a first voltage of the first branch and a second voltage of the second branch. Furthermore, the control loop comprises a filter coupled with an output of the transconductance amplifier. The filter provides an output signal controlling the provided first current and second current of the current source.

This bandgap reference circuit has the advantage that a reference voltage with low noise can be provided, wherein an operating current of the bandgap reference circuit can be kept low, in particular very low in the sub-1 μA region. A transconductance of the transconductance amplifier and the filter contribute to an attenuation of an output noise of the transconductance amplifier.

In one embodiment according to the first aspect, the supply circuit comprises a current mirror circuit. Advantageously, such a supply circuit allows for a precise controlling of the first and second currents.

In a further embodiment according to the first aspect, the filter contributes to an attenuation of an output noise of the transconductance amplifier.

In a further embodiment according to the first aspect, the filter element comprises a capacitor or consists of a capacitor. Such a filter allows an easy implementation. Preferably, the capacitor comprises a metal-oxide-semiconductor capacitor (MOS capacitor) to allow for an easy implementation within a COMS process.

In a further embodiment according to the first aspect, the transconductance amplifier comprises a tunable bias current source by which a transconductance of the transconductance amplifier is adjustable. By such a tunable "transconductance-capacitor-filter" bandgap noise deviations due to process and temperature variations can be compensated.

In a further embodiment according to the first aspect, the bandgap reference circuit comprises a voltage regulator configured to derive from a supply voltage of a supply voltage source of the bandgap reference circuit an input voltage for the supply circuit with a constant voltage level. Advantageously, by using the voltage regulator, a power-supply rejection-ratio (PSRR) of the bandgap reference circuit can be improved.

In a further embodiment according to the first aspect, the voltage regulator comprises a second filter for smoothing voltage ripples of the supply voltage of the supply voltage source of the bandgap reference circuit.

In a further embodiment according to the first aspect, the second filter comprises an RC-filter element. Hence, the second filter can easily be manufactured.

In a further embodiment according to the first aspect, the second filter comprises two cross-coupled polysilicon diodes forming a resistance in a gigaohm-range. In this way the voltage regulator can be implemented with low chip area costs.

In a further embodiment according to the first aspect, the voltage regulator comprises a pass transistor configured and arranged to decouple the input voltage of the supply circuit from supply voltage ripples of the supply voltage source of the bandgap reference circuit. So, the supply circuit may not be affected by the voltage ripples of the supply voltage of the supply voltage source. Preferably, the pass transistor comprises a native NMOS transistor. Advantageously, in this way there is only a very small voltage drop across the pass transistor. So the input voltage of the supply circuit can be very close to the supply voltage provided by the supply voltage source of the bandgap reference circuit.

The voltage regulator does not increase or only negligibly increases the required operating current of the bandgap reference circuit.

The invention is distinguished according to a second aspect by a readout circuit for a MEMS microphone with a bandgap reference circuit according the first aspect, providing a reference voltage to at least one low dropout regulator and/or a temperature sensor and/or a sigma-delta modulator of the readout circuit. Using the bandgap reference circuit the requirements of the application, in particular the requirements of a readout for a MEMS microphone with regard to power consumption, long battery life and noise can be fulfilled.

Advantageous embodiments of the first aspect are also valid for the second aspect.

The invention is distinguished according to a third aspect by a method for providing a reference voltage by a bandgap reference circuit comprising a voltage generator, a supply circuit and a control loop with a transconductance amplifier and a filter. The voltage generator, comprising a first and a second branch, produces a reference voltage with a temperature coefficient lower than a given threshold. The supply circuit provides a first current to the first branch and a second current to the second branch of the voltage generator. The transconductance amplifier of the control loop provides a differential output signal dependent on a first voltage of the first branch and a second voltage of the second branch. Furthermore, the filter of the control loop, which is coupled with an output of the transconductance amplifier, contributes to an attenuation of an output noise of the transconductance amplifier and provides an output signal controlling the first current and second current of the supply circuit.

Figure 2:
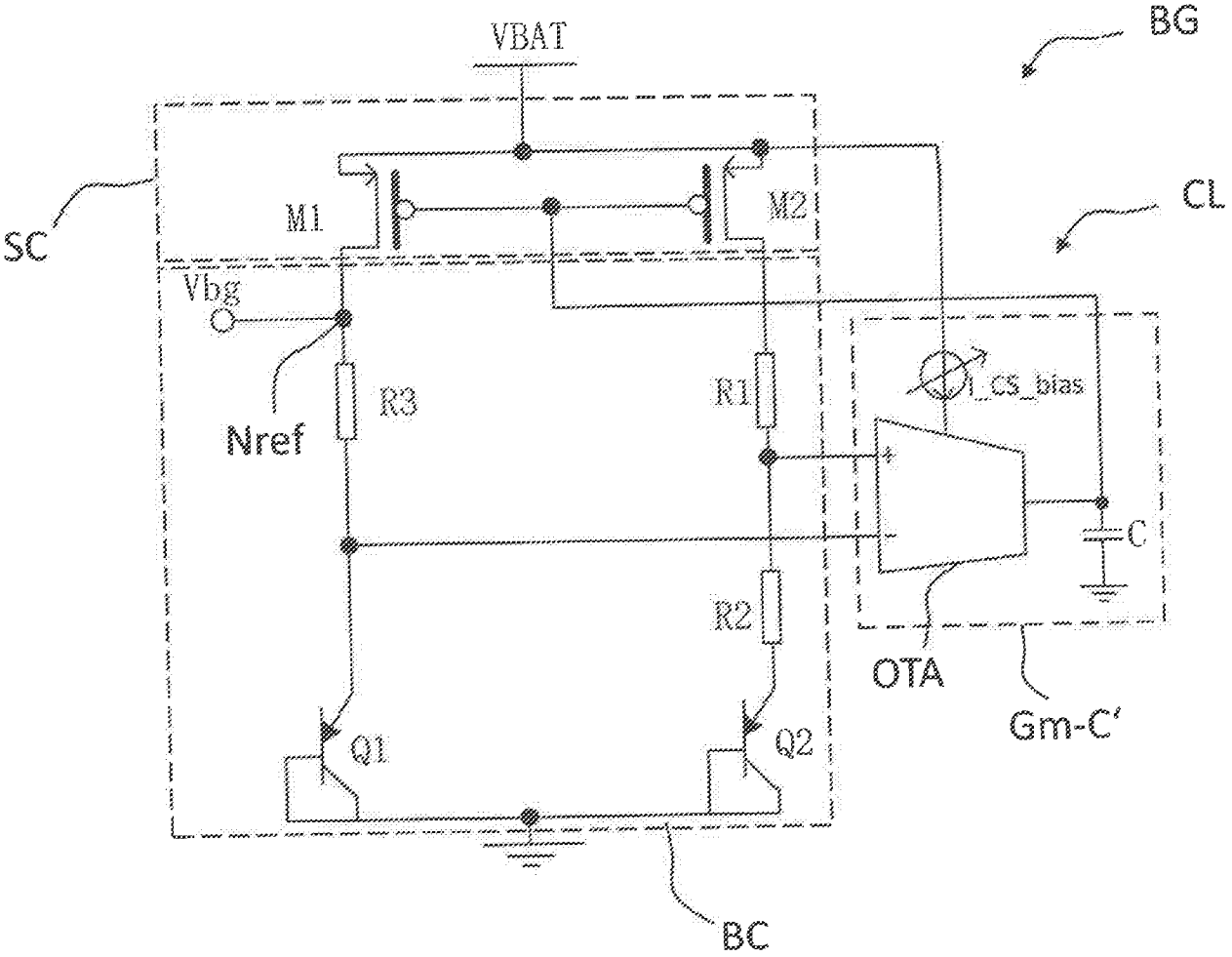
Figure 3:
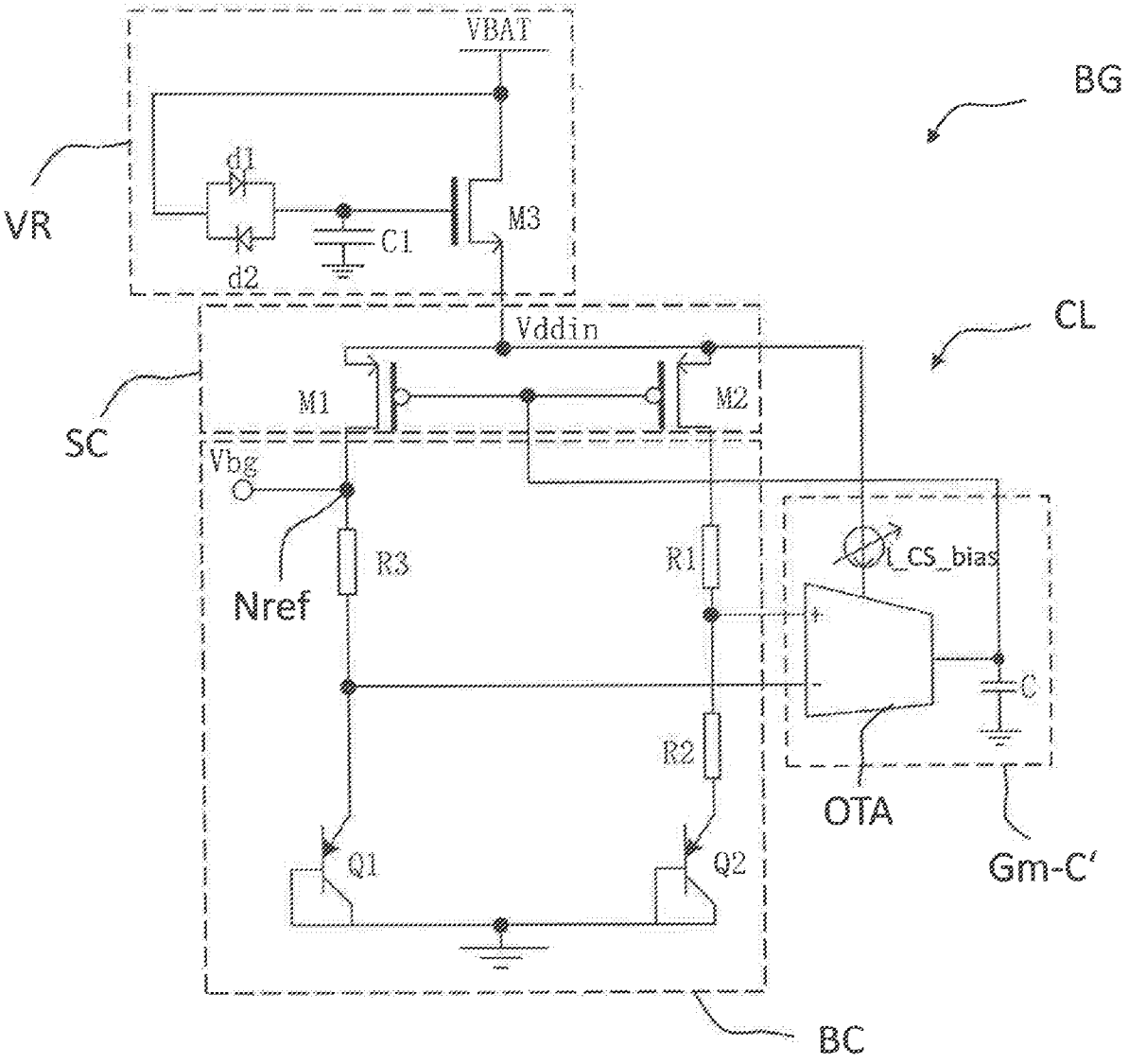

Exemplary embodiments of the invention are explained in the following with the aid of schematic drawings. These are as follows:

FIG. 1 a first exemplary embodiment of a bandgap reference circuit,

FIG. 2 a second exemplary embodiment of a bandgap reference circuit,

FIG. 3 a third exemplary embodiment of a bandgap reference circuit, and

Figure 4:
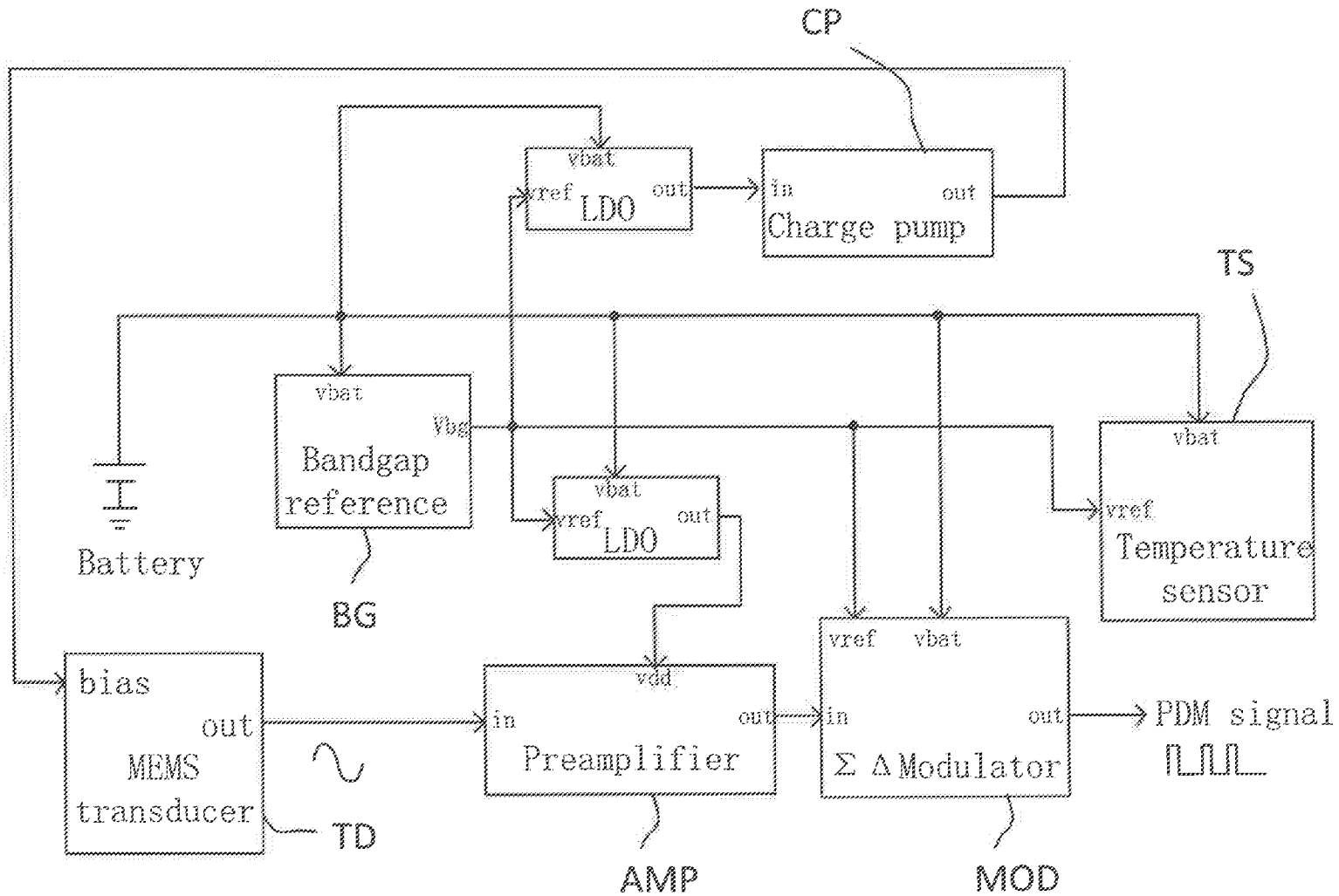

FIG. 4 a first exemplary embodiment of a readout circuit for a MEMS microphone.

Elements of the same design and function that appear in different figures are identified by the same reference numerals.

FIG. 1 shows a first exemplary embodiment of a bandgap reference circuit BG comprising a voltage generator BC, also called bandgap core, and a supply circuit SC. The voltage generator BC comprises a first and a second branch and is configured to produce a reference voltage vref with a temperature coefficient lower than a given threshold. The supply circuit SC is configured to provide a first current to the first branch and a second current to the second branch of the voltage generator BC.

The voltage generator BC comprises, for instance, a first, a second and a third resistor R1, R2 and R3, which each have a first connection point 1 and a second connection point 2. The first, second and third resistors R1, R2 and R3 can be thin film resistors. The third resistor R3 is arranged in a first branch of the voltage generator BC. The first and the second resistors R1, R2 are arranged in the second branch of the voltage generator BC. The first and third resistor R1, R3 may have equal resistances.

The supply circuit SC comprises a current source. In an exemplary embodiment the current source comprises a current mirror circuit with a first transistor M1 and a second transistor M2.

The first and second transistors M1, M2, for instance, each comprise a PMOS transistor (p-channel metal-oxide semiconductor transistor), or the first and the second transistor M1, M2 are PMOS transistors. A source of the first and second transistors M1, M2 is connected to a high potential terminal VBAT of a supply voltage source (not shown). A drain of the first and second transistors M1, M2 is connected to the third resistor R3 and the first resistor R1, respectively.

Alternatively the current source may comprise a single transistor, for example a PMOS transistor, which provides a current which is split into the first branch and the second branch.

The voltage generator BC further comprises a first and a second control element Q1, Q2. The first and second control elements Q1, Q2 may each comprise a diode element, for example a diode connected bipolar transistor with a first connection point 1, a second connection point 2 and a control input 3, where the first connection points 1 correspond to collectors, the second connection points 2 correspond to emitters and the control inputs 3 correspond to bases.

The first control element Q1 is, for example, formed by n elementary transistors. The first control element Q1 may be a PNP transistor with the base and collector connected to a reference potential terminal GND of the supply voltage source.

The third resistor R3 and the first control element Q1 are, for instance, arranged series connected in the first branch.

Thus, in the first branch the third resistor R3 is connected with the first point to the drain of the first transistor M1 and with the second point to the first control element Q1.

Hence, the first transistor M1, the third resistor R3 and the first control element Q1 are connected in series between the terminals of the voltage supply source.

In the second branch the first resistor R1 is connected with its first point to the drain of the second transistor M2 and with its second point to the first point of the second resistor R2. The second point of the second resistor R2 is connected to the second control element Q2.

The second control element Q2 is, for example, formed by m elementary transistors. The second control element Q2 may be a PNP transistor with the base and collector connected to the reference potential terminal GND of the supply voltage source.

Hence, the second transistor M2, the first and second resistors R1, R2 and the second control element Q2 are connected in series between the terminals of the voltage supply source.

The voltage generator BC comprises a control loop. The control loop comprises a transconductance amplifier OTA configured and arranged to provide an output signal representative of a difference between a first voltage tapped on the first branch and a second voltage tapped on the second branch. So the transconductance amplifier OTA functions as a differential amplifier.

Furthermore, the control loop comprises a filter coupled with an output of the transconductance amplifier OTA, the filter providing an output signal controlling the output currents of the current source.

Thus, a controlled first current is supplied by the first transistor M1, and a controlled second current is supplied by the second transistor M2.

The first voltage is preferably tapped between the third resistor R3 and the first control element Q1. The second voltage is preferably tapped between the first resistor R1 and the second resistor R2.

A bandgap reference output voltage Vbg is defined at the connection node between the first point of the third resistor R3 and the drain of the first transistor M1.

The value of the bandgap reference output voltage Vbg is defined by the following equation:

$$Vbg=Vq+R3\cdot\ln(m/n)\cdot UT/R2=Vq+K\ UT$$

where Vq is the diode voltage VBE of the first diode-connected PNP transistor of the first control element Q1, which is formed of n elementary bipolar transistors. UT is the thermal voltage UT=kT/q, wherein k is the Boltzmann constant, T an absolute temperature and q the elementary charge. The diode voltage VBE varies inversely with temperature variation.

Factor K for adjusting the first order temperature stability is R3·ln(m/n)/R2.

In this bandgap reference circuit BG, the bandgap reference output voltage Vbg may be a stable voltage at 1.2V, and it is temperature-independent or nearly temperature-independent as the temperature coefficient of the bandgap reference output voltage Vbg is less than 15 ppm/° C.

In the following section a numerical analysis of an output noise on the reference node Nref is provided. In a first step a circuit is analyzed wherein the control loop comprises only an operational amplifier instead of the transconductance amplifier OTA and the filter as shown in FIG. 1.

There are different noise sources. Eq (1) shows the contribution from each noise source to the bandgap noise $\overline{V_{n,bg}}^2$ in this bandgap reference circuit BG at reference node Nref.

$$\overline{V_{n,bg}}^2=\overline{V_{n,R1}}^2+\overline{V_{n,R2}}^2+\overline{V_{n,R3}}^2+\overline{V_{n,M1}}^2+\overline{V_{n,M2}}^2+\overline{V_{n,op}}^2 \quad (1)$$

The first, second and third resistors R1, R2, R3 contribute thermal noise, $\overline{V_{n,R1}}^2$, $\overline{V_{n,R2}}^2$ and $\overline{V_{n,R3}}^2$. The first and second transistors M1, M2, realized for instance as PMOS transistors, contribute noise $\overline{V_{n,M1}}^2$ and $\overline{V_{n,M2}}^2$, wherein $\overline{V_{n,M1}}^2$ and $\overline{V_{n,M2}}^2$, respectively, is a combination of both thermal noise and flicker noise. The comparator, in particular the operational amplifier (OP), contributes noise $\overline{V_{n,op}^2}$, which is a combination of both thermal noise and flicker noise. In addition, the first and second control elements Q1, Q2, which for instance comprise bipolar transistors, contribute shot noise, but in comparison to the other noise sources this shot noise is negligible.

The thermal noise of the first, second and third resistors R1, R2, R3 is given by eq. (2) to (4)

$$\overline{V_{n,R1}^2} = \int_{f1}^{f2} 4kTR1\left(\frac{1/gm_{Q1}+R3}{1/gm_{Q1}}\right)^2 df \tag{2}$$

$$\overline{V_{n,R2}^2} = \int_{f1}^{f2} 4kTR2\left(\frac{1/gm_{Q1}+R3}{1/gm_{Q1}}\right)^2 df \tag{3}$$

$$\overline{V_{n,R3}^2} = \int_{f1}^{f2} 4kTR3df \tag{4}$$

wherein k is the Boltzmann constant, T is the temperature and $gm_{Q1}$ is the transconductance of the first control element Q1. The noise bandwidth comprises the range from f1 to f2, determined by the application, for example f1=20 Hz and f2=20 kHz in a typical audio application.

The noise of the first and second transistors M1, M2 is given by eq. (5) and (6)

$$\overline{V_{n,M1}^2} = \int_{f1}^{f2}\left(\frac{8kTgm_{M1}}{3}+\frac{K_p gm_{M1}^2}{C_{M1}f}\right)\left(R3+\frac{1}{gm_{Q1}}\right)^2 df \tag{5}$$

$$\overline{V_{n,M2}^2} = \int_{f1}^{f2}\left(\frac{8kTgm_{M2}}{3}+\frac{K_p gm_{M2}^2}{C_{M2}f}\right)\left(R2+\frac{1}{gm_{Q2}}\right)^2\left(\frac{1/gm_{Q1}+R3}{1/gm_{Q1}}\right)^2 df \tag{6}$$

wherein k is the Boltzmann constant, T is the temperature, $gm_{M1}$ is the transconductance of the first transistor M1, $gm_{M2}$ is the transconductance of the second transistor M2, $K_p$ is the flicker noise parameter, $C_{M1}$ is the gate capacitor of the first transistor M1, $C_{M2}$ is the gate capacitor of the second transistor M2, $gm_{Q2}$ is the transconductance of the second control element Q2. The noise bandwidth is from f1 to f2, determined by the application, for example f1=20 Hz and f2=20 kHz in a typical audio application.

The noise of the operational amplifier is given by eq. (7)

$$\overline{V_{n,op}^2} = \int_{f1}^{f2} \overline{V_{op,out}^2}\left(gm_{M1}\left(\frac{1}{gm_{Q1}}+R3\right)\right)^2 df \tag{7}$$

wherein $\overline{V_{op,out}^2}$ is the output noise of the operational amplifier, $gm_{M1}$ is the transconductance of the first transistor M1, $gm_{Q1}$ is the transconductance of the first control element Q1. The noise bandwidth is from f1 to f2, determined by the application, for example f1=20 Hz and f2=20 kHz in the typical audio application.

Based on eq. (2) to (7), the bandgap noise $\overline{V_{n,bg}^2}$ is dominated by the noise of the operational amplifier $\overline{V_{n,op}^2}$ because the output noise of the operational amplifier $\overline{V_{op,out}^2}$ is much larger compared to the noise terms:

$$4kTR1,\ 4kTR2,\ 4KTR3,$$

$$\frac{8kTgm_{M2}}{3}+\frac{K_p gm_{M2}^2}{C_{M1}f},\ \text{and}$$

$$\frac{8kTgm_{M1}}{3}+\frac{K_p gm_{M1}^2}{C_{M1}f}.$$

Therefore, for achieving a low noise bandgap reference circuit, the output noise $\overline{V_{op,out}^2}$ of the operational amplifier in eq. (7) should be as small as possible to get a small noise of the operational amplifier $\overline{V_{n,op}^2}$.

However, there is a further requirement, namely to realize a low current bandgap.

The operating current of the bandgap reference circuit BG is dominated by the operational amplifier OP. The current of the operational amplifier OP should be as low as possible to achieve a sub-1 μA bandgap reference circuit.

The operating current of the operational amplifier OP is inversely proportional to its output noise $\overline{V_{n,op}^2}$. So, an operational amplifier OP with ultra-low current leads to very large output noise $\overline{V_{n,op}^2}$ of the operational amplifier OP. This means there is a conflict between low current and low noise in designing this bandgap reference circuit BG with the operational amplifier.

In a second step an embodiment of a bandgap reference circuit BG according to the invention is analyzed. In this case the control loop comprises the transconductance amplifier OTA and the filter as shown in FIG. 1.

In the following the term "Gm-C filter" is used for the circuit combination of the transconductance amplifier OTA and the filter and the also term Gm cell is used for the term transconductance amplifier OTA.

In the bandgap reference circuit BG shown in FIG. 1, the bandgap reference output voltage Vbg is, for example, a stable voltage at 1.2V, and it is temperature-independent as the temperature coefficient of the bandgap reference output voltage Vbg is less than 15 ppm/° C.

Eq. (8) shows the contribution from each noise source to the bandgap noise $\overline{V_{n,bg}^2}$ in this bandgap reference node Nref.

$$\overline{V_{n,bg}^2}=\overline{V_{n,R1}^2}+\overline{V_{n,R2}^2}+\overline{V_{n,R3}^2}+\overline{V_{n,M1}^2}+\overline{V_{n,M2}^2}+\overline{V_{n,Gm\text{-}C}^2} \tag{8}$$

In comparison to eq. (1) the Gm-C filter contributes Gm-C filter noise $\overline{V_{n,Gm\text{-}C}^2}$. The Gm-C filter noise is given by eq. (9)

$$\overline{V_{n,Gm-C}^2} = \int_{f1}^{f2} \overline{V_{Gm,out}^2}\frac{1}{1+(f/(Gm/C))^2}\left(gm_{M1}\left(\frac{1}{gm_{Q1}}+R3\right)\right)^2 df \tag{9}$$

wherein $\overline{V_{Gm,out}^2}$ is the output noise of the Gm cell, Gm is the transconductance of the Gm cell, C is the load/filter capacitor, $gm_{M1}$ is the transconductance of the first transistor M1, $gm_{Q1}$ is the transconductance of the first control element Q1. The noise bandwidth is from f1 to f2, determined by the application, for example f1=20 Hz and f2=20 kHz in the typical audio application.

The bandgap noise $\overline{V_{n,bg}^2}$ is mainly dominated by the Gm-C filter noise $\overline{V_{n,Gm\text{-}C}^2}$ because the Gm cell output noise $\overline{V_{Gm,out}^2}$ is much larger compared to respective terms:

$4kTR1$, $4kTR2$, $4KTR3$, $$\frac{8kTgm_{M2}}{3} + \frac{K_p gm_{M2}^2}{C_{M1} f} \text{ and}$$

$$\frac{8kTgm_{M1}}{3} + \frac{K_p gm_{M1}^2}{C_{M1} f}.$$

For reaching a low bandgap noise $\overline{V_{n,bg}^2}$ in particular the Gm cell output noise $\overline{V_{Gm,out}^2}$ could be minimized in eq. (9).

The operating current of the bandgap reference is mainly dominated by the Gm cell. The current of the Gm cell should be as low as possible to achieve a sub-1 μA bandgap reference. In particular, the operating current of a Gm cell is inversely proportional to its output noise $\overline{V_{Gm,out}^2}$ and is proportional to its transconductance Gm. A Gm cell with ultra-low current indeed leads to a high Gm cell output noise $\overline{V_{Gm,out}^2}$. The new term $$\int_{f1}^{f2} \frac{1}{1 + (f/(Gm/C))^2}$$

is introduced in eq(9) by the Gm-C filter Gm-C, which provides an attenuation of the Gm cell output noise $\overline{V_{Gm,out}^2}$ beyond a rolloff frequency Gm/C. In eq. (9), the Gm cell output noise $\overline{V_{Gm,out}^2}$ is large due to sub-1 μA current, but at the same time, transconductance Gm is small. The small transconductance Gm provides a low rolloff frequency Gm/C which is close to f1, and this low rolloff frequency introduces a large attenuation of the Gm cell output noise $\overline{V_{Gm,out}^2}$ when integrated from f1 to f2. As a result, the Gm cell output noise $\overline{V_{n,Gm\text{-}C}^2}$ is attenuated dramatically. This finally leads to a low bandgap noise $\overline{V_{n,bg}^2}$. Hence, a low noise bandgap reference under sub-1 μA operation current can be realized.

The Gm cell, for example, may be implemented by an operational transconductance amplifier and a capacitor C with a capacity value in the range of 20 pF to 50 pF. For example, the capacitor C comprises or is a metal-oxide-semiconductor capacitor (MOS capacitor).

FIG. 2 shows another exemplary embodiment of a bandgap reference circuit BG. In comparison to the embodiment shown in FIG. 1 the Gm cell is replaced by a tunable Gm cell.

In this embodiment the transconductance Gm' of the Gm cell is tunable. Therefore, the Gm cell is biased by a tunable current source I_CS_bias. The noise analysis in this case is exactly the same as for the bandgap reference circuit BG shown in FIG. 1. The value of the transconductance Gm' is proportional to the magnitude of a bias current Ibias of the current source I_CS_bias. Assuming the output noise of the Gm cell, $\overline{V_{Gm,out}^2}$, could be held relatively constant when bias current Ibias varies in a narrow range. An increase of the bias current Ibias leads to an increase of rolloff frequency Gm'/C, which increases the Gm-C filter output noise according to eq.(9), and then finally increases the bandgap noise $\overline{V_{n,bg}^2}$ according to eq.(8). Decrease of the bias current Ibias leads to a decrease of rolloff frequency Gm'/C, which decreases the Gm-C filter output noise according to eq. (9), and then finally decreases the bandgap noise $\overline{V_{n,bg}^2}$ according to eq. (8). In this way, the bandgap noise $\overline{V_{n,bg}^2}$ can be easily calibrated to overcome any noise deviations due to process and temperature variations.

The tunable current source I_CS_bias, for example, comprises a programmable current source controlled by a one-time programmable (OTP) memory.

Thus, the bandgap noise $\overline{V_{n,bg}^2}$ can be easily calibrated. Thus an original design specification can be satisfied over a wide range of process and temperature variations.

FIG. 3 shows a further exemplary embodiment of the bandgap reference circuit BG. In comparison to the embodiments shown in FIGS. 1 and 2 the bandgap reference circuit BG comprises a voltage regulator VR, in particular a zero-current pre-regulator. The voltage regulator VR is configured to regulate an output voltage of the supply voltage source, provided on the supply potential terminal VBAT, to generate a device input voltage on an input terminal Vddin. By filtering output voltage of the supply voltage source the voltage regulator VR may improve the power supply rejection ratio (PSRR) of the bandgap reference circuit BG without adding any current to the supply circuit SC and the voltage generator BC or the added current to the supply circuit SC and the voltage generator BC may be negligible.

The voltage regulator VR comprises a second filter for smoothing voltage ripples of the output voltage of the supply voltage source, provided on the supply potential terminal VBAT.

For example, the second filter comprises an RC-filter element. For instance, the second filter comprises a capacitor C1 and two cross-coupled polysilicon diodes d1, d2 forming a resistance in a gigaohm-range.

This passive lowpass filter removes ripples from the output voltage of the supply voltage source to the gate of pass transistor M3. The pass transistor M3 comprises, for instance, a native NMOS transistor. Native NMOS transistors are available in nowadays CMOS processes. Such a native NMOS transistor is realized by an NMOS transistor with additional process doping to support a very low threshold in the range of 0V to 0.2V. This allows a small voltage drop across pass transistor M3 so that the input voltage on the input terminal Vddin can be close to the output voltage of the supply voltage source, provided on the supply potential terminal VBAT.

The PSRR of this voltage regulator VR is given according to eq. (10) as $$PSRR_{pre} = \frac{Vddin}{VBAT} = \frac{1}{gm_{M3} rds_3}, \tag{10}$$

in which $gm_{M3}$ is the transconductance of the pass transistor M3 and $rds_3$ is the drain-source resistance of the pass transistor M3. The PSRR of the voltage generator BC is measured from the input voltage on the input terminal Vddin to the bandgap reference output voltage Vbg, as $$PSRR_{core} = \frac{Vbg}{Vddin}. \tag{11}$$

The total PSRR of the bandgap reference in FIG. 3 is equal to $PSRR_{pre}$*$PSRR_{core}$. For comparison, the total PSRR of the bandgap reference circuit BG shown in FIG. 2 is equal to $PSRR_{core}$. Thus, the total PSRR of the bandgap reference circuit BG shown in FIG. 3 is improved by introducing $PSRR_{pre}$.

FIG. 4 shows a block diagram of a readout circuit for a MEMS microphone (Micro-Electro-Mechanical Systems microphone) comprising the bandgap reference circuit BG as an exemplary application of the bandgap reference circuit BG. The readout circuit comprises a MEMS transducer. For example the MEMS transducer is biased with about 11V DC voltage output from a charge pump, and the MEMS transducer generates an audio signal in the range of 20 Hz to 20 KHz. The audio signal is amplified by a low noise preamplifier and the analog audio signal is converted to a digital pulse-density-modulation (PDM) output signal by a high resolution sigma-delta modulator. In this circuit, the bandgap reference circuit BG generates a stable, temperature-independent or nearly temperature-independent, bandgap reference output voltage Vbg, which is used as a reference voltage vref for two low dropout regulators LDO. The low dropout regulators LDO supply the low noise preamplifier AMP and the charge pump CP. The bandgap reference output voltage Vbg is further used as a reference voltage vref for the high resolution sigma-delta modulator MOD. Furthermore the bandgap reference output voltage Vbg is used as a reference voltage vref for the temperature sensor TS. All of these circuit blocks prefer a low noise bandgap reference. In FIG. 4 a readout circuit for a MEMS microphone is shown. However, the bandgap reference circuit BG can also be used for only one or standalone circuit blocks or any other combination of these circuit blocks. For example the bandgap reference circuit BG can be used only for the low dropout regulators LDO or the sigma-delta modulator MOD only or the temperature sensor TS.

The sigma-delta modulator MOD and the temperature sensor TS are supplied by an external battery. The bandgap reference circuit BG provides a high PSRR, thus a good performance of the audio application can be reached.

Often the readout circuit can be set into standby mode when the readout channel is idle. In the standby state of the readout circuit, the preamplifier AMP, the sigma-delta modulator MOD and the temperature sensor TS can set into sleep mode with zero current consumption. But the charge pump CP should always work normally to bias the MEMS transducer even in a standby state. So the bandgap reference circuit BG, one LDO and the charge pump CP should work all the time. Therefore, the current consumption of the bandgap reference circuit BG consumes a large part of the standby current of the readout circuit. With the provided Bandgap reference circuit BG the readout circuit for MEMS can be implemented with low current. So, the bandgap reference circuit BG contributes to minimize the standby current and leads to a long battery life.

REFERENCE NUMERALS

AMP Preamplifier
BC voltage generator
BG bandgap reference circuit
C capacitor of filter
C1 capacitor of second filter
CP charge pump
d1, d2 first and second diodes
Gm-C, Gm-C' Gm-C filter
GND reference potential terminal
I_CS_bias tunable bias current source
LDO low dropout regulator
M1, M2 first and second transistors
M3 pass transistor
MOD sigma-delta Modulator
Nref reference node
OTA transconductance amplifier
Q1, Q2 first and second control elements
R1, R2, R3 first, second and third resistors
SC supply circuit
TD transducer
TS temperature sensor
VBAT supply potential terminal
Vbg bandgap reference output voltage
Vddin input voltage terminal
VR voltage regulator
vref reference voltage

The invention claimed is:

1. A bandgap reference circuit comprising:
- a voltage generator comprising a first branch and a second branch and being configured to produce a reference voltage with a temperature coefficient lower than a given threshold;
- a supply circuit configured to provide a first current to the first branch and a second current to the second branch of the voltage generator; and
- a control loop comprising:
  - a transconductance amplifier configured to provide an output signal representative of a difference between a first voltage of the first branch and a second voltage of the second branch; and
  - a filter coupled to an output of the transconductance amplifier, the filter configured to provide an output signal for controlling the first current and second current of the supply circuit.

2. The bandgap reference circuit according to claim 1, wherein the supply circuit comprises a current mirror circuit.

3. The bandgap reference circuit according to claim 1, wherein the filter is configured contribute to an attenuation of an output noise of the transconductance amplifier.

4. The bandgap reference circuit according to claim 1, wherein the filter comprises a capacitor.

5. The bandgap reference circuit according to claim 1, wherein the transconductance amplifier comprises a tuneable bias current source configured to adjust a transconductance of the transconductance amplifier.

6. The bandgap reference circuit according to claim 1, further comprising a voltage regulator configured to derive from a supply voltage of a supply voltage source of the bandgap reference circuit an input voltage for the supply circuit with a constant voltage level.

7. The bandgap reference circuit according to claim 6, wherein the voltage regulator comprises a second filter configured to smooth voltage ripples of the supply voltage of the supply voltage source.

8. The bandgap reference circuit according to claim 7, wherein the second filter comprises an RC-filter element.

9. The bandgap reference circuit according to claim 7, wherein the second filter comprises two cross-coupled polysilicon diodes forming a resistance in a gigaohm-range.

10. The bandgap reference circuit according to claim 6, wherein the voltage regulator comprises a pass transistor configured to decouple the input voltage of the supply circuit from supply voltage ripples of the supply voltage source of the bandgap reference circuit.

11. A readout circuit for a MEMS microphone comprising:
- a bandgap reference circuit comprising:
  - a voltage generator comprising a first branch and a second branch and being configured to produce a reference voltage with a temperature coefficient lower than a given threshold;
  - a supply circuit comprising a current mirror circuit configured to provide a first current to the first branch and a second current to the second branch of the voltage generator; and a control loop comprising:

a transconductance amplifier configured to provide an output signal representative of a difference between a first voltage of the first branch and a second voltage of the second branch; and a filter coupled to an output of the transconductance amplifier, wherein the filter is configured to provide an output signal for controlling the first current and second current of the supply circuit and to contribute to an attenuation of an output noise of the transconductance amplifier, wherein the filter comprises a capacitor, and wherein the bandgap reference circuit is configured to provide the reference voltage to:

at least one low dropout regulator, and/or a temperature sensor, and/or a sigma-delta modulator of the readout circuit.

12. The readout circuit according to claim 11, wherein the transconductance amplifier comprises a tuneable bias current source configured to adjust a transconductance of the transconductance amplifier.

13. The readout circuit according to claim 11, further comprising a voltage regulator configured to derive from a supply voltage of a supply voltage source of the bandgap reference circuit an input voltage for the supply circuit with a constant voltage level, and wherein the voltage regulator comprises a second filter configured to smooth voltage ripples of the supply voltage of the supply voltage source of the bandgap reference circuit.

14. The readout circuit according to claim 13, wherein the second filter comprises two cross-coupled polysilicon diodes forming a resistance in a gigaohm-range.

15. The readout circuit according to claim 13, wherein the voltage regulator comprises a pass transistor configured and arranged to decouple the input voltage of the supply circuit from supply voltage ripples of the supply voltage source of the bandgap reference circuit.

16. A method for providing a reference voltage by a bandgap reference circuit comprising a voltage generator comprising a first branch and a second branch, a supply circuit, and a control loop with a transconductance amplifier and a filter, the method comprising:

producing, by the voltage generator, a reference voltage with a temperature coefficient lower than a given threshold;

providing, by the supply circuit, a first current to the first branch and a second current to the second branch of the voltage generator;

providing, by the transconductance amplifier of the control loop, a differential output signal dependent on a first voltage of the first branch and a second voltage of the second branch; and contributing, by the filter coupled to an output of the transconductance amplifier, to an attenuation of an output noise of the transconductance amplifier and providing an output signal controlling the first current and second current of the supply circuit.

* * * * *